US006564853B1

(12) United States Patent
Ratte

(10) Patent No.: US 6,564,853 B1
(45) Date of Patent: May 20, 2003

(54) MULTIPLE CASTING APPARATUS AND METHOD

(75) Inventor: Robert W. Ratte, North Oaks, MN (US)

(73) Assignee: Water Gremlin Company, White Bear, MN (US)

( * ) Notice: Subject to any disclaimer, the term of this patent is extended or adjusted under 35 U.S.C. 154(b) by 0 days.

(21) Appl. No.: 09/458,198

(22) Filed: Dec. 10, 1999

Related U.S. Application Data

(63) Continuation-in-part of application No. 09/170,247, filed on Oct. 13, 1998.

(51) Int. Cl.[7] ..... B22D 18/02; B22D 27/15

(52) U.S. Cl. ..... 164/113; 164/120; 164/61; 164/312

(58) Field of Search ..... 164/61, 120, 457, 164/113, 312

(56) References Cited

U.S. PATENT DOCUMENTS 4,497,359 A * 2/1985 Suzuki et al. ..... 164/120
4,753,283 A * 6/1988 Nakano ..... 164/312
4,967,827 A * 11/1990 Campbell ..... 164/134
5,048,590 A * 9/1991 Carter ..... 164/120
5,244,033 A * 9/1993 Ueno ..... 164/312
6,202,733 B1 * 3/2001 Ratte ..... 164/61

FOREIGN PATENT DOCUMENTS

EP 0559920 * 9/1993

* cited by examiner

*Primary Examiner*—M. Alexandra Elve
*Assistant Examiner*—Len Tran

(57) ABSTRACT

An apparatus and method for pressure casting a plurality of battery terminal wherein the molten lead is prevented from entering the mold cavities until molten lead is present by the inlets of all the mold cavities with the inlets to the molds simultaneously opened to allow molten lead therein and simultaneously closed with the volume of each of the mold cavities in each of the mold cavities is quickly reduced to thereby cause the molten lead solidifies under the reduced volume and high pressure produces a battery terminal that is substantially free of both tears and cracks.

9 Claims, 7 Drawing Sheets

MULTIPLE CASTING APPARATUS AND METHOD

CROSS REFERENCE TO RELATED APPLICATIONS

This application is a continuation in part of my copending application Ser. No. 09/170,247 filed Oct. 13, 1998 titled APPARATUS AND METHOD OF PRESSURE CASTING BATTERY TERMINALS.

FIELD OF THE INVENTION

This invention relates generally to pressure casting of multiple parts and, more specifically to simultaneous pressure casting of lead and lead alloy battery terminals to inhibit the formation of cracks and tears during the solidification of the battery terminal.

BACKGROUND OF THE INVENTION

Battery terminals, which are typically made of lead or a lead alloy, are usually cold formed in order to produce a battery terminal that is free of voids and cracks. If lead or lead alloy battery terminals are pressure cast, air is left in the battery terminal cavity in the mold so that as the lead solidifies, the air bubbles prevent the battery terminal from cracking. That is, the air bubbles act as fillers so the lead remains distributed in a relatively uniform manner throughout the battery terminal. Unfortunately, air bubbles within the battery terminal cause the battery terminal to be rejects as the air bubbles can produce large voids in the battery terminal. In order to minimize the air bubbles in the battery terminal, a vacuum can be drawn in the battery terminal cavity mold; however, although the vacuum removes air from the mold and inhibits the forming of air bubbles in the battery terminal, the battery terminals cast with a vacuum in the battery terminal cavity oftentimes solidify in an uneven manner producing battery terminals with cracks or tears which makes the battery terminal unacceptable for use. In the present process, a battery terminal is cast which is substantially free of cracks and tears by pressure casting a lead alloy while a vacuum is being applied to the battery terminal cavity. After the lead in the battery terminal cavity reaches the liquid-to-solid transformation stage, a piston is driven into the mold to rapidly reduce the volume of the mold. By precisely controlling the time of application of an external compression force to the lead in the battery terminal cavity, and consequently, the time at which the volume of the battery terminal cavity is reduced, one can force the into a smaller volume while the pressure on the battery terminal cavity is maintained. By maintaining the pressure on the battery terminal cavity during the solidification process, the battery terminal can be cast in a form that is substantially free of cracks and tears.

In the present invention a plurality of molds are connected to a runner to allow one to simultaneously form a plurality of battery terminals followed by using an external compression force to intensify the pressure of the lead to produce a battery terminal substantially free of cracks and tears.

SUMMARY OF THE INVENTION

Briefly, the system comprises an apparatus and method for simultaneously pressure casting a plurality of battery terminals to produce a plurality of battery terminals substantially free of tears and cracks. A gate formed by a retracting piston extends into each of the plurality of battery terminals molds to maintain the battery terminal mold in a closed condition so that molten lead cannot enter any of the molds until a specified time. When the molten lead has filled the runners to all the battery terminal molds and while the lead is still in the molten state the gates to each of the battery terminal are opened simultaneously so that all the battery terminal molds can receive the molten lead at the same time. After a predetermined time sufficient to allow for filling of the molds the set of retractable pistons are simultaneously driven into their respective molds to thereby increase the pressure on the lead therein. As the lead in each of the molds solidifies under the reduced volume and pressure it simultaneously produces a plurality of battery terminal that are substantially free of both tears and cracks.

DESCRIPTION OF THE PREFERRED EMBODIMENT

Figure 1:
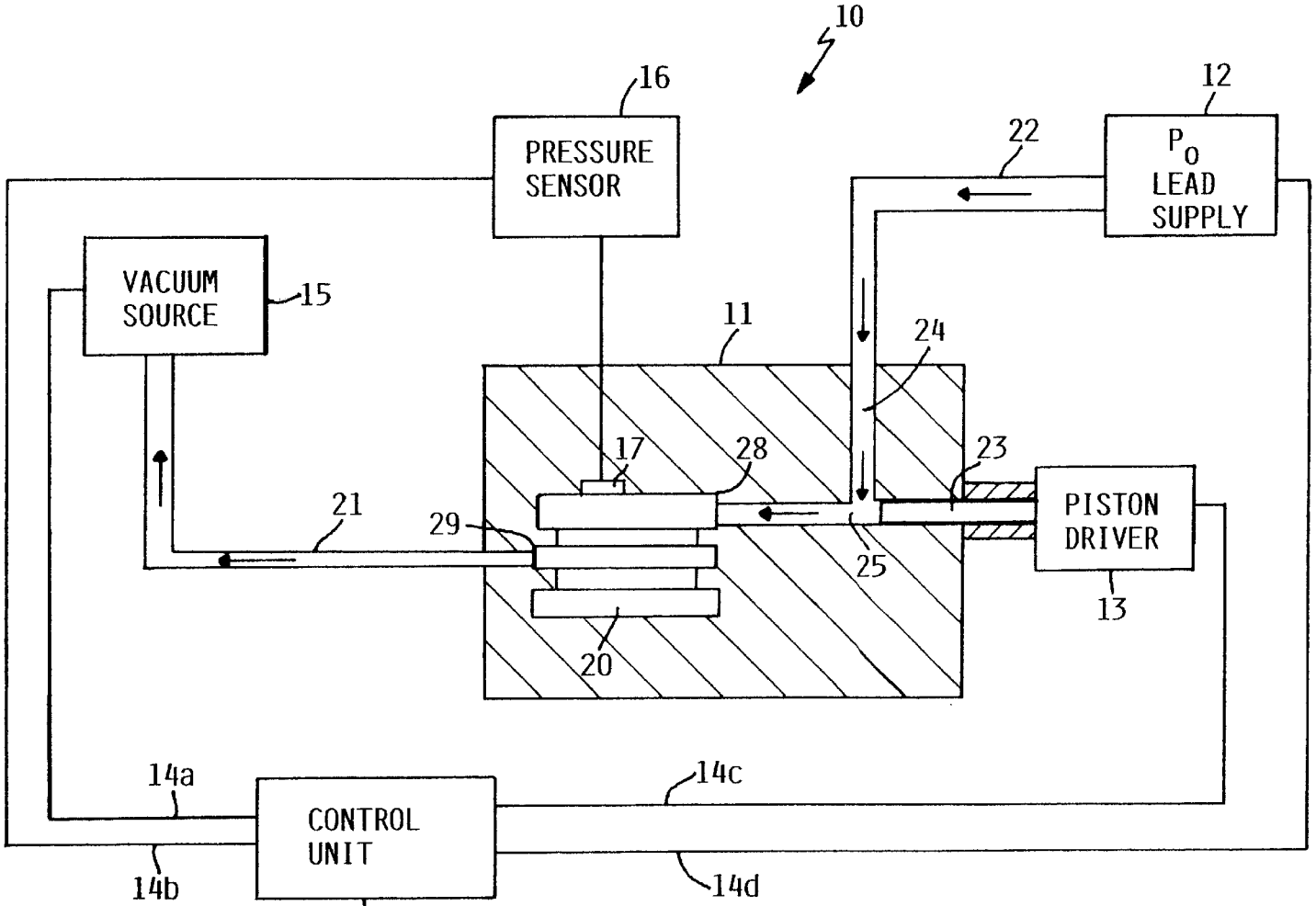
FIG. 1 is a partial schematic of a system for pressure casting of a battery terminal to inhibit the cracking or tearing of the battery terminal during the solidification process.
Figure 5:
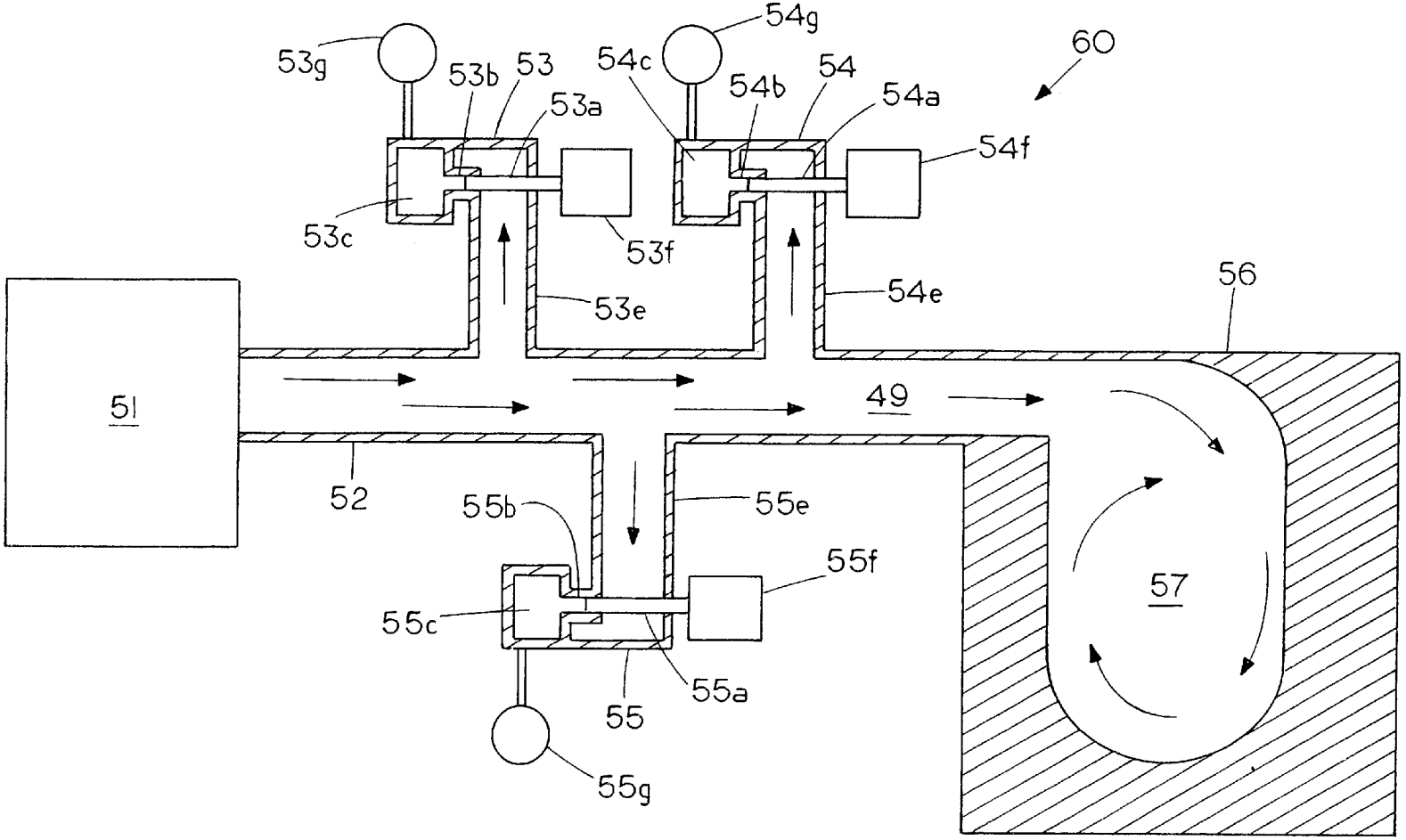
FIG. 5 shows the system of FIG. 1 wherein a single mold and retraction member has been replaced by multiple molds and multiple retraction members with the retraction members in the closed condition.

Referring to FIG. 1 reference numeral 10. generally identifies a pressure casting unit for pressure casting of a single battery terminal to inhibit formation of cracks and tears in a pressure cast battery terminal and FIG. 5 discloses a system for simultaneously casting a plurality of pressure cast battery terminal to inhibit formation of cracks and tears in each of the plurality of pressure cast battery terminals.

The pressure casting unit 10 includes a source of pressurized molten lead 12 (which could be a source of pressurized alloy of lead) for directing molten lead under pressure into a mold 11. Mold 11 has a battery terminal cavity 20 located therein with a runner 24 for supplying molten pressurized lead from pressurized lead source 12 to battery terminal cavity 20.

Pressure casting unit 10 includes a vacuum source 15 which is connected to a cold spot on battery terminal cavity 20 to enable the vacuum source 15 to evacuate the air from battery terminal cavity 20 through passage 21 prior to supplying molten lead to the battery terminal cavity 20.

Pressure casting unit 10 also includes a pressure sensor 16 having a probe 17 mounted in mold 11 with probe 17 mounted in position to form a portion of the mold surface surrounding the battery terminal cavity 20. Pressure sensor probe 17 is preferably placed in a hot spot of the mold, i.e. a spot that cools at a slower rate. By placing the probe 17 in a portion of the mold that remains in a liquid state, one can monitor the pressure of the molten lead in the liquid state as the molten lead is supplied to battery terminal cavity 20.

Located in slideable relationship in passage 25 is a cylindrical piston 23 for driving into inlet passage 25 of mold 11. A piston driver 13, which carries piston 23 connects to mold 11 to hold piston 23 in an out of the way condition as molten lead is being forced into battery terminal cavity 20. Piston 23 provides a mechanical means for reducing the volume available for solidification of the lead therein.

In order to control the operation of pressure casting unit 10, a control unit 14 is included with pressure casting unit 10. Control unit 14 connects to vacuum source 15 via electrical lead 14*a* and to pressure sensor. 16 via electrical lead 14*b*. Similarly, control unit 14 connects to molten lead supply 12 through electrical lead 14*d* and to piston driver 13 through electrical lead 14*c*.

The control unit 14, which can be a computer with appropriate software, receives signals from pressure sensor 16, which transmits the pressure of the molten lead in battery terminal cavity 20. That is, as the molten lead from the pressurized lead source 12 fills the battery terminal cavity, the pressure on probe 17 is continually transmitted to pressure sensor 16 and onward to control unit 14. When the pressure in battery terminal cavity 20 reaches a predetermined level, control unit 14 sends a signal to piston driver 13 which quickly drives piston 23 into passage 25 to simultaneously cutoff and seal passage 25. As piston 23 plunges into the passage, it reduces the volume for the lead that is in the liquid-to-solid transformation stage. By reducing the volume the lead during the liquid-to-solid transformation stage, one can compensate for the lead shrinking and contracting as the molten lead solidifies. Consequently, the finished cast product is free of tears and cracks that would effect the performance of the battery terminal. While the control unit can be set to be responsive to the pressure in the battery terminal cavity the control unit can also be set to reduce the volume of lead after a certain period of time has elapsed. The elapsed time will depend on the size and configuration of the pressure cast part. Since it is difficult to access all the factors that effect the cooling rate of a particular part it is preferred to determine the time to compress the second charge of lead by a test run of wherein the various parts are compressed at different times. By inspecting the test run one can determine the proper time for comprising the charge of lead for a particular mold.

Figure 2:
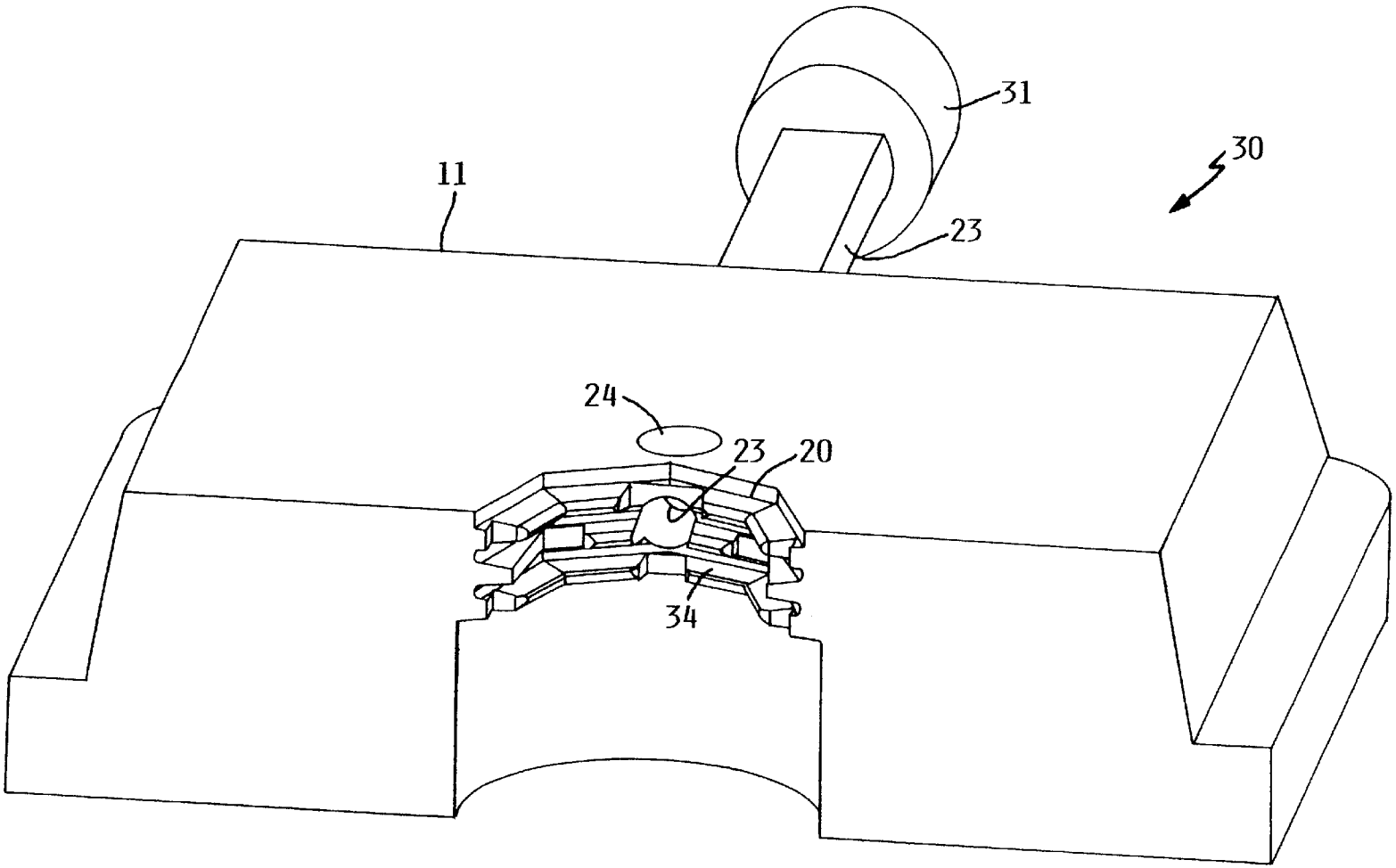
FIG. 2 is a diagram showing a portion of the mold and the piston that is driven into the runner of the mold.

Referring to FIG. 2, mold 11 has been opened to reveal a portion of mold 11 and piston 23 which are shown in perspective view in relation to a portion of battery terminal cavity 20. Extending out of one side of mold 11 is piston 23 having a head 31 for engagement with a hydraulic cylinder or the like. Battery terminal cavity 20 is defined by a set of radial fins 34 that project into the battery terminal cavity 20.

With pressure casting unit 10 one can pressure cast a lead battery terminal to inhibit formation of tears and cracks in the battery terminal. In one embodiment the formation of tears and cracks in the cast battery terminal, the state of molten lead is continuously monitored so that after the molten lead enters the liquid-to-solid transformation stage, the volume of the mold available for the lead to solidify therein can be quickly reduced to force the lead, while it is still flowable, into the smaller volume. By rapidly reducing the volume and maintaining pressure on the molten lead, one causes the lead to solidify as a solid terminal substantially free of tears and cracks. It should be pointed out that in the liquid-to-solid transformation stage, the lead is in a condition where it can flow and is sometimes referred to as a "mush". Normally, as the molten lead goes through the liquid-to-solid transformation stage, the volume of lead contracts which results in a finished product that will have cracks or tears when it is completely solidified.

To illustrate the operation of pressure casting unit 10 refer to FIG. 1 which shows the mold 1 assembled with the battery terminal cavity 20 located within the mold. One end of a vacuum conduit 21 is attached to vacuum source 15, and the other end of vacuum conduit 21 is attached to a location on the mold 11 which is referred to as a "cold spot". That is, the lead in this portion of the mold is referred to as a "cold spot" as the molten lead in this region will solidify sooner than the molten lead being fed into the mold through runner passage 25. Consequently, as the lead begins to solidify in the "cold spot" the solidified lead immediately closes the end of conduit 21 which prevents molten lead from being drawn into the vacuum source 15. The location of a cold spot or cold spots will vary on the shape and size of the casting. For any particular shape battery casting, one can generally determine the cold spots by determining the regions of the mold that are less massive than others. If needed, one can also determine the cold spot through trial and error.

In addition to the positioning of a vacuum passage in mold 11 one can place a pressure probe 17 on the surface boundary of the battery mold cavity 20 in order to determine when the molten lead reaches the liquid-to-solid transformation stage. While the temperature could be measured to determine when the lead reaches the liquid-to-solid transformation stage, the time lag between the actual temperature of the lead and the measured temperature may be sufficiently long so that the actual temperature of the molten lead may have cooled sufficiently so the lead is no longer in the liquid-to-solid transformation stage even though the temperature probe indicates that the temperature of the lead is in the liquid-to-solid transformation stage. However, by measuring the pressure using a pressure probe, one is able to obtain a pressure reading which can more quickly determine when the molten lead enters the liquid-to-solid transformation stage. By being able to more quickly determine the molten state of the lead, one can still have sufficient time to active the piston driver 13 to drive the piston 23 into the molten lead and force the lead to flow into a reduced volume before the lead passes completely through the liquid-to-solid transformation stage.

With the pressure casting unit 10 in the condition shown in FIG. 1, the control unit 14 can activate the molten lead supply to deliver molten lead under pressures of 40,000 psi or higher to pipe 22 which delivers the molten lead under pressure to runner 24. The molten lead flows in the directions indicated by the arrows in runners 24 and 25. Note, in this condition piston 23 is located behind runner 24 so that molten lead flows from runner 24 to runner 25 and into battery terminal cavity 20. While the molten lead is flowing into battery terminal cavity 20, the vacuum source removes air from battery terminal cavity 20 with the air flowing through vacuum source 15 as indicated by arrow in conduit 21. As previously mentioned, air evacuation conduit 21 terminates at a cold spot indicated by reference numeral 29 while the molten lead enter battery terminal cavity at what is considered a hot spot 28, i.e. an area where the lead solidifies last.

Once the molten lead enters the battery terminal cavity 20, the molten lead fills up the battery terminal cavity and the lead in the cold spot 29 begins to solidify thereby preventing further molten lead from being drawn out of the mold and into conduit 21. It should be pointed out that the size of the opening in the cold spot is kept sufficiently small so that the molten lead will solidify and quickly fill the open end of conduit 21, yet the conduit 21 is sufficiently large so that the air can quickly be evacuated from the battery terminal cavity 20. While the use of a cold spot to close off the flow of lead from the mold is shown other methods of closing the mold such as a movable piston could be used.

As the vacuum passage 21 is sealed off the pressure in the battery terminal cavity 20 begins to rise under the pressure of the molten lead supply. When the pressure reaches a predetermined level, which can be determined by the shape and size of the battery terminal being cast, the control unit 14 senses the pressure and sends a signal to piston driver 13. Piston driver 13 includes a quick action hydraulic cylinder or the like which quickly fires piston 23 foreword, which simultaneously cuts off the supply of additional molten lead from runner 24, while reducing the volume in which the lead will solidify.

If desired, the decrease in volume can be determined based on trial and error. That is, by observing the finished product for cracks and tears, one can determine if more volume reduction is necessary as insufficient volume reduction of the lead or lead alloy leaves cracks and tears in the finished battery terminal.

Figure 3:
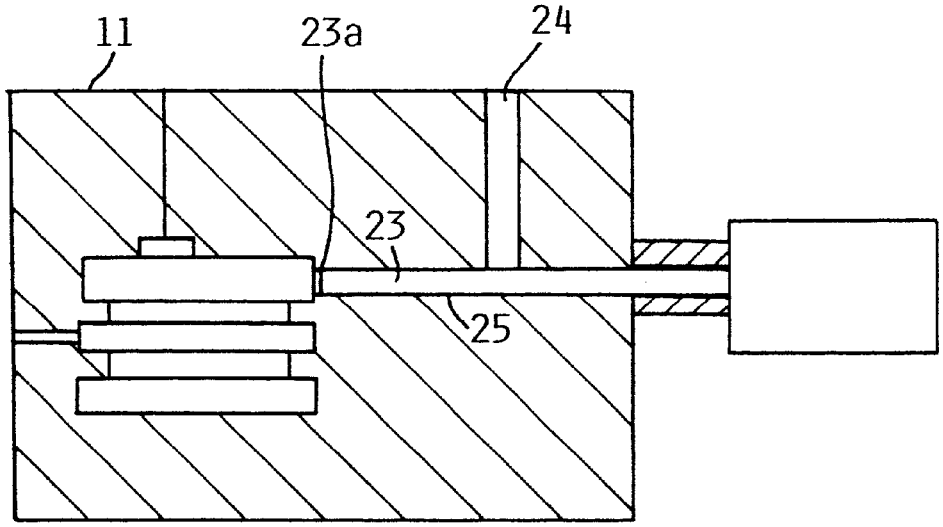
FIG. 3 shows a portion of the system of FIG. 1 with the piston in the extended position that produces a reduced volume for the solidification of a lead or lead alloy.

FIG. 3 shows a portion of pressure casting unit 10 with mold 11. In the condition shown in FIG. 3 the piston 23 has been driven into the passage 25 thereby cutting off the flow of additional molten lead through runner 24. At the same time the end of piston 23 has forced the molten lead in passage 25 into the mold by pushing the molten lead ahead of end 23*a* of piston 23. Thus the volume for molten lead to solidify therein has been decreased by forcing the piston end 23*a* proximate the battery terminal cavity 20. In the preferred method, the piston end 23*a* is driven to the outer confines of the battery terminal cavity 20 thereby eliminating a protrusion on the battery casting. That is, the end 23*a*, when in the piston shown in FIG. 3 defines the end of a portion of the battery terminal being cast therein.

Figure 4:
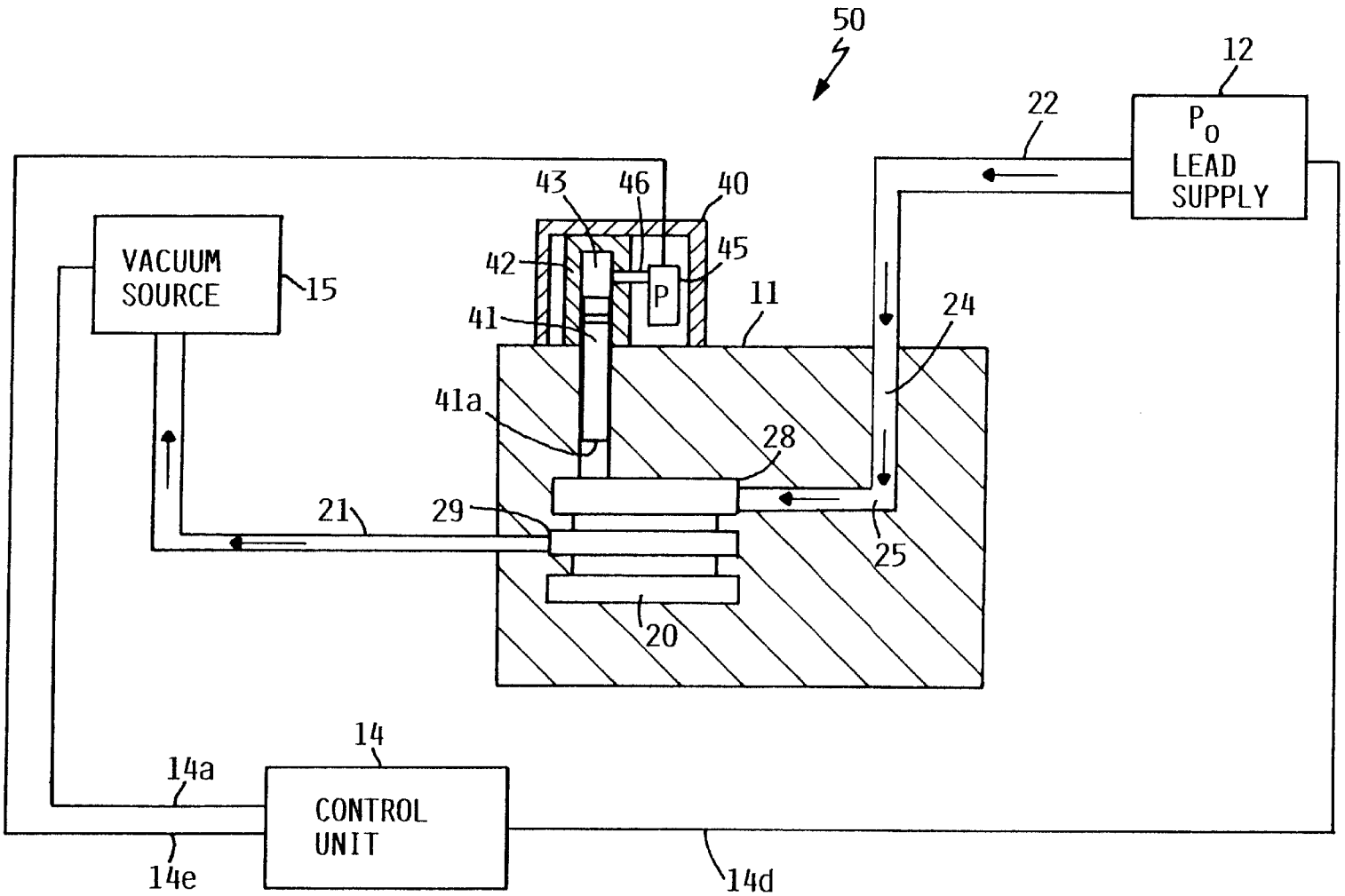
FIG. 4 shows an alternate system wherein a piston is maintained under pressure during the casting process.

FIG. 4 shows an alternate embodiment of my system that uses a piston 41 that is maintained under a predetermined pressure. The components of System 60 that are identical to the components in pressure casting unit 10 are shown with identical numbers. System 60 includes a housing 40 which is secured to mold 11. Housing 40 includes a cylinder 42 that has a slidable piston 41 located therein. A chamber 43 is located above the top end of piston 41. A high pressure source 45 connects to chamber 43 though conduit 46. The control for high pressure 45 source comes from control unit 14 and through lead 14*a*. Piston 41 is shown in the slightly elevated condition and during the course of its operation the lower end 41*a* of piston 41 will move from a position flush with the surface of the battery terminal casting 20 to a position above the battery terminal casting 20 (shown in FIG. 4) and eventually again to a position where end 41*a* is flush with the surface of the lead battery terminal casting 20.

In the embodiment of FIG. 4 the piston 41 is positioned in a hot spot in the mold. The lead is then injected under pressure into mold 28 though inlet 24. During this stage of the molding process the injection pressure of the lead builds to a level where the pressure of the lead in the mold is sufficient to force piston 41 upward as shown in FIG. 4. As the mold begins to cool and the supply of lead to the battery terminal cavity is terminated the pressure in the battery terminal cavity 20 begins to decrease. As the pressure in the mold decreases it reaches a point where the pressure forces on the top end of piston 41 become greater than the pressure forces on the bottom end 41*a* of piston 41. In this condition piston 41 is driven downward by the pressurized air in chamber 43 causing the volume available for the lead to solidify therein to be reduced. As long as the piston 41 is located in a hot spot on the mold the lead is forced into a smaller volume as it solidifies. Consequently, the reduction of volume causes the battery casting formed therefrom to be formed which is substantially free of cracks. If desired, one can ensure that the lead does not solidify in the area where the piston contacts the molten the piston by maintained a temperature of the piston in excess of the molten lead in the mold.

FIG. 5 shows a multi part casting System 60 wherein instead of a single mold and retraction member as shown in FIG. 1 the system includes multiple pressure casting units 53, 54 and 55. For ease in understanding the operation of the multiple part casting system the control unit and connections thereto are not included. A source of molten lead 51 directs molten lead 49 to main runner 52. At the end of main runner 52 there is a lead and impurity reservoir 56 with a cavity 57 that allows the first charge of lead, which usually contains impurities, to flow therein. Once the lead with impurities have been siphoned off to the reservoir 56 the second charge of molten lead is directed into a series of secondary runners 53*e*, 54*e* and 55*e* that extend from runner 52 to the respective pressure casting units 53, 54 and 55.

As each of the pressure casting units 53, 54 and 55 are identical only one will be described herein. Pressure casting unit 54 includes a retractable piston 54*a* and an inlet or sleeve 54*b* that forms sealing mating engagement with the retractable piston 54*a* to prevent flow of lead therepast. Retractable piston is extendible or retractable through a driver 54*f*. In the embodiment shown in FIG. 5 the retractable piston 54*a* is shown in a partially extended position that closes the inlet 54*b* to mold cavity 54*c*. Similarly, the retractable pistons 53*a* and 55*a* are also located in the closed condition to prevent molten lead from entering the mold cavities 53*c* and 55*c* in the pressure casting units 53 and 55. Thus during the initial phase of pressure casting with multiple molds each of the mold cavities are temporarily sealed off to prevent molten lead from entering the mold cavities. Consequently, the first charge of molten lead 49 flows along runner 52 and fills the reservoir 56. As the first charge of molten lead usually contains impurities the lead in the reservoir 56 is recycled at a later time.

Figure 6:
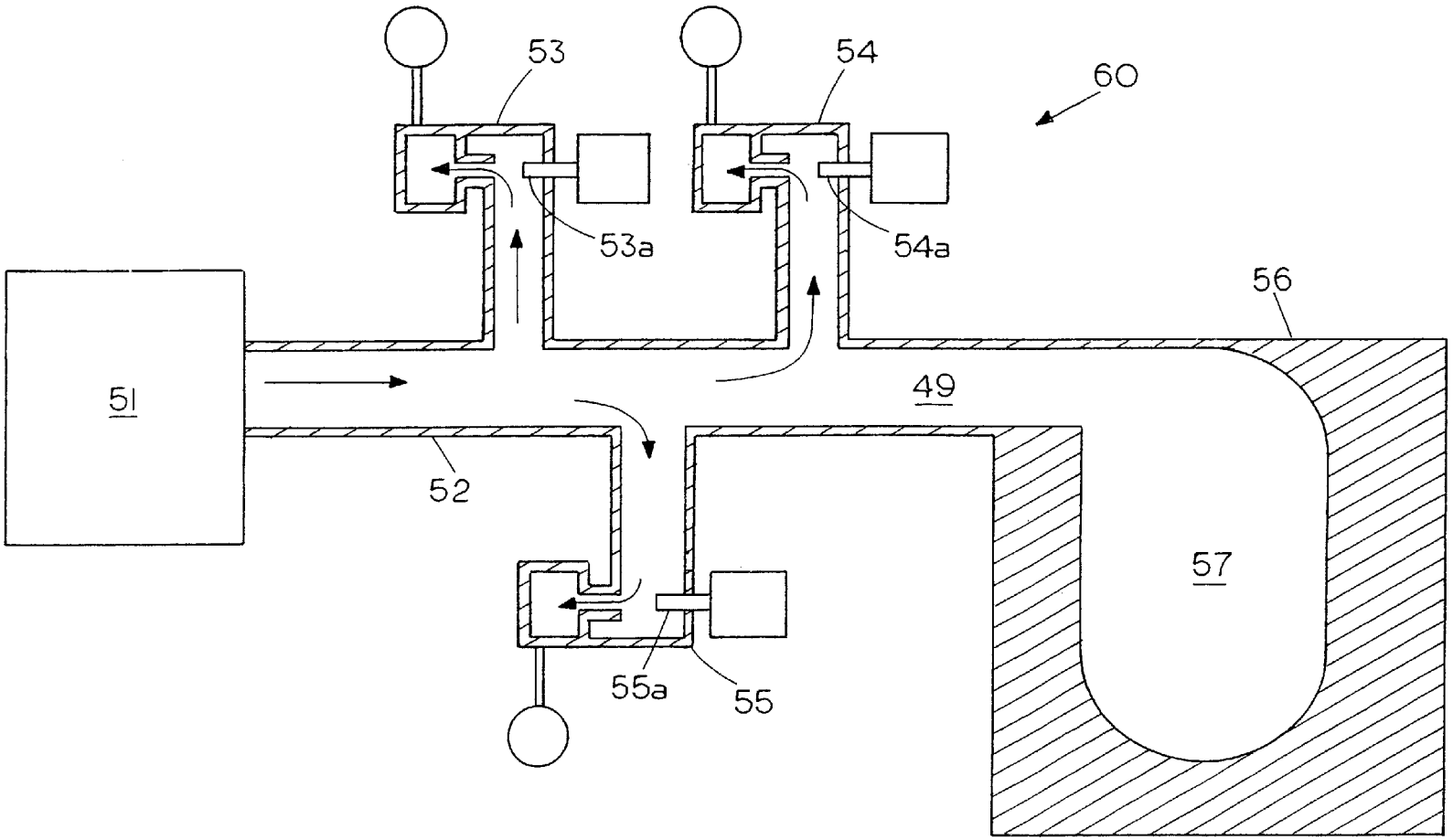
FIG. 6 shows the system of FIG. 5 wherein the retraction members have been simultaneously opened to allow molten lead to flow into the molds.

FIG. 6 shows the system 50 of FIG. 5 in the second phase wherein each of the retraction members 53*a*, 54*a* and 55*a* have been simultaneously opened to allow molten lead to flow simultaneously into the respective mold cavities 53*c*, 54*c* and 55*c*. That is, only until the molten lead is present in all the secondary runners 53*e*, 54*e* and 55*e* are the retraction member simultaneously retracted to allow molten lead to flow into the pressure casting units. This allows for all the cavities to be filled with lead at the same time.

Figure 7:
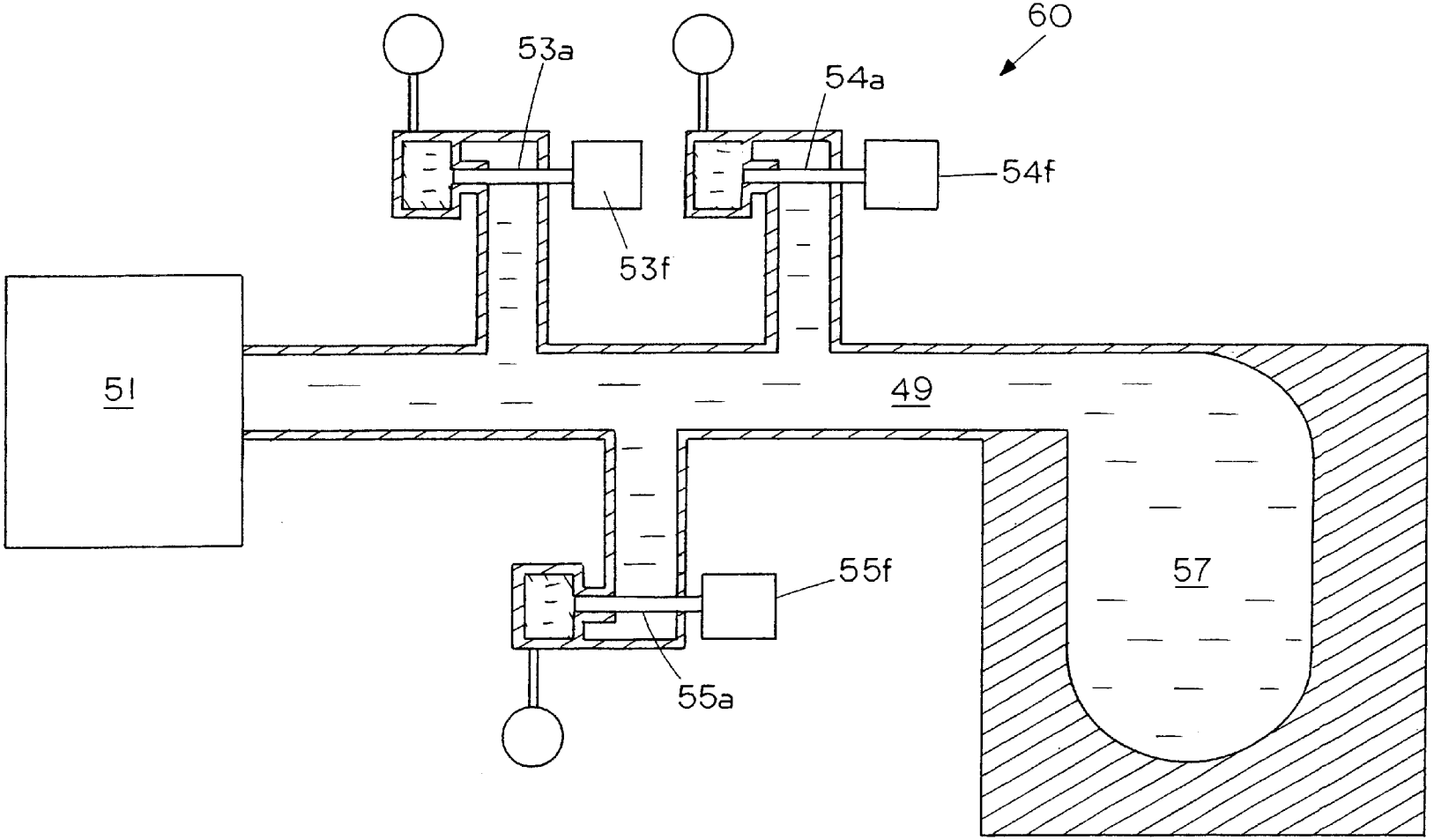
FIG. 7 shows the system of FIG. 5 wherein the retraction members have been simultaneously driven into the lead in the mold cavity to increase the pressure to thereby eliminate voids and cracks in a plurality of cast battery parts.

FIG. 7 shows the system of FIG. 7 in the third phase wherein the retraction members 53*a*, 54*a* and 55*a* have been simultaneously driven into the lead in the mold cavity to increase the pressure to thereby substantially eliminate voids and cracks in a plurality of cast battery parts. FIG. 7 shows that retractable piston 53*a*, 54*a* and 55*a* have been driven into the respective sleeves to decrease the volume of the second charge of lead in mold to thereby simultaneously form a plurality of battery terminal substantially free of voids and cracks. It will be appreciated that the system of FIG. 5 allows one to accurately control the time before the pressure in each of the mold is increased thus creating multiple parts of the same consistency.

Thus the system for simultaneously pressure casting a plurality of lead parts includes a source of pressurized molten lead 51, a reservoir 57 and a main runner 52 in fluid communication with reservoir 57 for receiving a first charge of molten lead having impurities therein. Connected to main runner 52 through a set of secondary runners are a plurality of mold cavities 53*c*, 54, and 55*c* each having an inlet for directing a second charge of molten lead into the mold cavities. A set of retractable pistons 53*a*, 54*a* and 55*a* with each of the retractable pistons postionable with respect to an inlet to prevent a second charge of molten lead from flowing therepast. A plurality of drivers 54*f*, 55*f* and 53*f*, each of which are operable to extend the retractable pistons with sufficient force so as to compress the second charge of lead in the mold cavities and a control unit 14 that allows one to simultaneously close each of the inlets, simultaneously open each of the inlets and simultaneously drive each of the retractable pistons into the second charge of lead to thereby form a lead part substantially free of tears and cracks.

What is claimed is:

1. The method of pressure casting a plurality of battery terminals parts while inhibiting the formation of cracks and tears comprising the steps of:

evacuating a plurality of battery terminal cavities to remove air therefrom;

directing a first charge of molten lead into a first runner;

injecting a second charge of molten lead under pressure into a plurality of runners each of which extend into a battery terminal cavity while an inlet to each of the battery terminal cavities is closed off;

simultaneously opening the inlet to each of the battery terminal cavities to allow the second charge of molten lead to flow therein; and simultaneously extending a retractable piston into the second charge of molten lead in each of the battery terminal cavities to reduce volume of the second charge of molten lead before the second charge of molten lead solidifies thereby inhibiting the formation of cracks and tears in the battery terminal formed therein.

2. The method of claim 1 including the step of driving each of the pistons to a point coterminous with the battery terminal cavity outline in the mold to thereby produce a battery terminal that is free of a protrusion that requires further processing.

3. The method of claim 1 including the step of driving each of the pistons at sufficient speed so as to reduce the volume of the molten lead in each of the cavities before the molten lead solidifies.

4. The method of claim 1 including the step directing the first charge of molten lead into a reservoir for recycling at a later time.

5. The method of pressure casting a plurality of battery parts while inhibiting the formation of cracks and tears comprising the steps of:

injecting a charge of molten lead under pressure into a battery part cavity having a volume; and reducing the volume of the battery part cavity before the charge of molten lead therein solidifies to thereby inhibit the formation of cracks and tears in the battery part formed therein; and wherein the step of injecting the charge of the molten lead under pressure into a battery part cavity is preceded by directing a first charge of molten lead into a reservoir.

6. The method of claim 5 further reducing the volume of the battery part cavity comprises driving a piston into the battery part cavity to thereby reduce the volume of the battery part cavity.

7. The method of claim 6 including the step of driving the piston at sufficient speed so as to reduce the volume of the molten lead in the cavity before the molten lead solidifies.

8. The method of claim 7 including the step of simultaneously injecting molten lead into a plurality of battery part cavities.

9. The method of claim 8 including the step of simultaneously reducing the volume in each of the plurality of battery part cavities.

* * * * *